204-297 SR
2/11/86 XR 4,569,744

United States Patent [19]

Walker

[11] Patent Number: 4,569,744

[45] Date of Patent: Feb. 11, 1986

[54] ANODIC ASSEMBLY FOR ELECTROPLATING

[76] Inventor: Charles T. Walker, 14841 Meyers Rd., Detroit, Mich. 48227

[21] Appl. No.: 649,306

[22] Filed: Sep. 11, 1984

[51] Int. Cl.[4] ..... C25B 11/03; C25B 11/12; C01B 31/00; H01R 43/00

[52] U.S. Cl. ..... 204/284; 204/287; 204/294; 204/290 R; 204/297 R; 264/29.5; 264/105; 264/156; 29/825; 427/113

[58] Field of Search ..... 204/284, 287, 294, 290 R, 204/297 R; 427/113; 264/29.5, 105, 156; 29/825

[56] References Cited

U.S. PATENT DOCUMENTS

| | | | |
|---|---|---|---|
| 208,003 | 9/1878 | Wenzel | 204/287 |
| 1,231,955 | 7/1917 | Slater | 204/283 X |
| 3,300,396 | 1/1967 | Walker | 204/284 X |
| 3,397,087 | 8/1968 | Yoshizawa et al. | 427/113 |
| 3,529,997 | 9/1970 | Grangaard | 427/113 X |

*Primary Examiner*—Donald R. Valentine
*Attorney, Agent, or Firm*—Michael Ebert

[57] ABSTRACT

An anodic assembly immersible in a fluoborate electrolytic bath in an electroplating process for plating tin and similar metals. The assembly is constituted by a cylindrical basket containing a replenishable pile of solid pieces of the plating metal, the basket being formed by a perforated carbon tube closed at its bottom by a carbon plug. The outer surface of the tube is impregnated with a resin acting as a reinforcing skin to prevent cracking when the tube is drilled to create the required perforations.

6 Claims, 3 Drawing Figures

ANODIC ASSEMBLY FOR ELECTROPLATING

BACKGROUND OF INVENTION

1. Field of Invention

This invention related generally to electroplating, and more particularly to an anodic assembly constituted by a basket of electrically conductive material containing a replenishable pile of solid pieces of the metal to be plated.

2. Prior Art

Electroplating is the process of coating an article with a thin layer of a metal through electrolytic deposition. The article to be plated is immersed in an electrolytic bath and serves as the cathode in the electrolytic system. Also immersed in the bath is an anode composed of the plating metal. A low voltage is applied between the cathode and the anode, causing a current to pass through the electrolytic solution which electrolyzes and plates the cathodic article with the anodic metal to the desired thickness. In this way, articles may be plated with silver, copper, cadmium, nickel, and a variety of other metals.

The present invention is primarily concerned with anode structures for electroplating pure tin, various tin-lead alloys, copper and other metals for which the appropriate electrolytic bath is fluoborate acid ($HBF_4$) Electroplating in a fluoborate bath is now used on a large scale in the manufacture of printed circuit boards in which the metal plated on an insulated substrate forms the conductive lines of the electrical circuit.

A professional electroplater in any given situation is concerned not only with carrying out this operation efficiently and at the lowest possible cost, but also with producing platings which are uniform in thickness and of good quality. In the context of printed circuit boards, uniform platings of good quality are vital to the proper operation of the circuit. Three main factors come into play in determining the uniformity and quality of plating.

The first factor is constant anode area. In the conventional bar-type anode used in electroplating, as the anode is consumed in the course of electroplating, the bar takes on the form of a spear or an irregular sponge-like mass whose over-all surface is much reduced with respect to the original anode. While at the outset of the plating process one may attain a fairly constant level of metal ions in solution, with the inevitable shrinkage of the anode in the course of dissolution, it is no longer possible to maintain optimum plating conditions.

As conventional anodes of the bar type corrode, they not only assume an irregular shape but they lose weight, and when the weight is reduced to about 10% to 40% of its original value, the anodes must be replaced. The plating operation must therefore be shut down to permit the used-up anodes to be pulled out and replaced with new anode bars. This is a costly and time-consuming operation, and it gives rise to expensive scrap losses.

The second factor is constant current flow. In order to realize platings of uniform quality and thickness, the intensity of current flowing through the system must remain unchanged in the course of operation. But with bar anodes, the effective resistance of the anode varies as the anode corrodes, and the level of current flow is therefore uneven.

The third factor is contamination. In order to produce smooth, clean platings of good quality it is essential that the electrolytic bath be free of foreign ions. But should the anode structure include contaminants which electrolytically dissolve into the bath, the resultant platings will be of poor quality.

To obviate the drawbacks incident to the use of bar anodes, it has been known to provide anode assemblies wherein the anodic metal in piece form is contained in a plastic basket or a plastic-coated metallic basket. But since such baskets are electrically non-conductive, it becomes necessary, in order to electrify the structure, to place conductive strips or rod electrodes within the insulated basket to make contact with the anodic pieces therein.

Such plastic basket arrangements have several serious disadvantages. The strips or electrodes used to conduct the current to the anodic pieces are themselves subject to chemical attack by the electrolyte and hence have to be replaced periodically. Moreover, the strips or electrodes have a relatively small surface area and afford a poor and varying electrical contact with the anodic pieces. In the case of plastic-coated baskets, should the plastic skin be damaged the underlying metal is exposed and subject to attack by the electrolyte, as a result of which the basket is gradually destroyed and the electrolyte contaminated.

It has also been known to provide anode baskets formed of an electrically conductive metal such as steel. The difficulty with such arrangements is that these basket metals are chemically reactive with the acidic electrolyte normally used in electroplating, hence gas is generated and foreign ions are dissolved in the electrolyte which degrade the quality of the plating. Furthermore, such baskets, because they corrode, have a limited life and require replacement.

In my prior U.S. Pat. No. 3,300,396, whose entire disclosure is incorporated herein by reference, there is disclosed an anodic assembly for electroplating nickel, zinc and other metals. The assembly is constituted by a basket formed of titanium having small, closely-spaced openings therein, the basket being filled with a replenishable pile of anodic metal pieces, such as zinc balls.

The anodic assembly as well as the article to be plated which functions as a cathode are immersed in an acidic electrolyte, whereby when a voltage is applied between the anodic assembly and the cathodic article, the resultant current flow causes electrolytic dissolution of the anodic pieces, but not of the titanium basket. This anodic assembly is adapted to maintain the effective surface area of the anodic plating metal and the current distribution characteristics substantially constant. The metal ions in solution are maintained at a substantially uniform level to provide uniform platings of good quality.

As noted in my prior patent, titanium is an inherently active metal that is normally subject to corrosion in acids of the type ordinarily used in zinc, nickel and copper plating. However, when used in an electroplating system for these metals, the corrosion resistance of titanium is enhanced by an oxide film formed on its surface in the course of plating. This thin and adherent oxide film is chemically resistant to most acidic electrolytes. However, it has been found that in a fluoborate acid electrolyte, titanium is not rendered corrosion resistant and therefore is not suitable as a basket material for containing the anodic pieces.

SUMMARY OF INVENTION

In view of the foregoing, the main object of this invention is to provide an anodic assembly for carrying out electroplating in a fluoborate or other acidic electrolytes which are highly reactive with most metals, the assembly making use of an electrically-conductive basket which is chemically resistant to the electrolyte.

More specifically, it is an object of this invention to provide an anodic assembly which makes use of a non-corroding perforated carbon basket containing a pile of replenishable anodic metal pieces, the basket being permanently installed in the plating tank, thereby making it possible to carry out plating operations without interruption and to produce metallic coating of uniform thickness and high quality.

Also an object of the invention is to provide a method for fabricating a carbon basket having clean holes drilled therein without fracturing or otherwise degrading the structure of the carbon basket.

Briefly stated, these objects are attained in an anodic assembly immersible in a fluoborate electrolytic bath in an electroplating process for plating tin and similar metals. The assembly is constituted by a cylindrical basket containing a replenishable pile of solid pieces of the plating metal, the basket being formed by a perforated carbon tube closed at its bottom by a carbon plug. The outer surface of the tube is impregnated with a resin acting as a reinforcing skin to prevent cracking when the tube is drilled to create the required perforations.

OUTLINE OF DRAWINGS

For a better understanding of the invention as well as other objects and further features thereof, reference is made to the following detailed description to be read in conjunction with the accompanying drawings, wherein:

FIG. 1 schematically illustrates an electroplating system which includes an anodic assembly in accordance with the invention;

DESCRIPTION OF INVENTION

The Electroplating System

Figure 1:
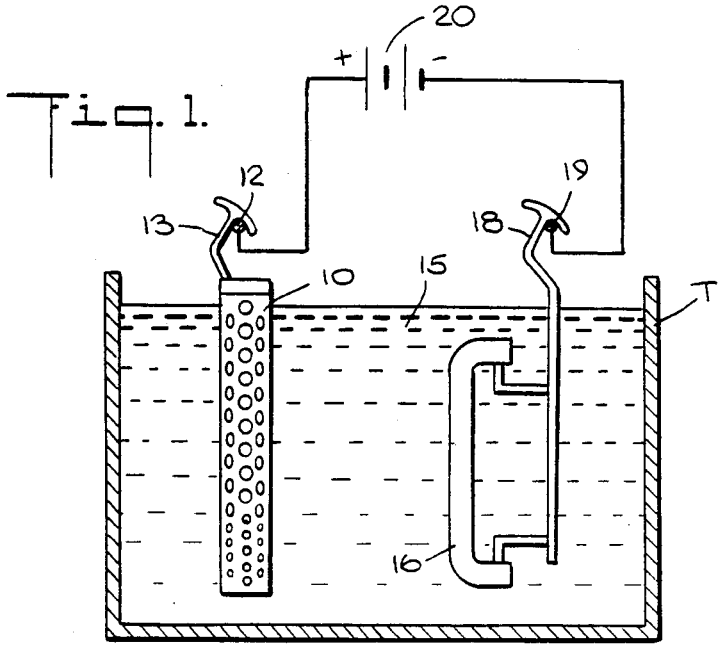

Referring now to FIG. 1, there is shown an electroplating system which makes use of an anodic assembly in accordance with the invention. The assembly is constituted by a perforated basket 10 in cylindrical form fabricated of electrically-conductive carbon material which is non-reactive with the electrolyte, and a replenishable pile of anodic pieces 11 of tin or other metal which fills the basket.

Basket 10 is suspended above a tank 14 from a positive bus bar 12 by means of a conductive hook 13 attached to a metal collar 14 of copper, monel metal or other highly conductive metal. The collar is clamped onto the unperforated upper end of the basket cylinder. Basket 10 is partially immersed in a fluoborate acid electrolytic bath 15 in tank T.

Fully immersed in the electrolyte is an article 16 to be plated. Article 16 is supported on an electrically-conductive rack 17 which is suspended by a conductive hook 18 from a negative bus bar 19. Negative bus bar 19 is connected to the negative terminal of a direct-current power supply 20 whose positive terminal is connected to positive bus bar 12.

The anodic pieces 11, which are shown in ball shape but which may be in other geometric shapes or in irregular shapes, are larger in diameter or maximum dimension than the holes in the perforated basket, but are smaller in size than the top opening of the basket. Thus as the anodic pieces are consumed in the course of electroplating, one can from time to time deposit additional pieces in the basket to maintain the height of the pile and to thereby hold the effective total surface area of the anodic pieces at a substantially constant value in the course of plating.

In practice, a fiberglass bag of the type disclosed in my prior patent, above-identified, may be attached to the anodic assembly to collect sludge particles dropping out of the assembly to prevent their deposition in the electrolyte.

The anodic pieces, which may be of tin, a tin alloy or any other metal appropriate to plating in a fluoborate acid electrolyte, make contact with each other within the pile and at the exterior of the pile, also make multiple points of contact with the inner surface of the carbon basket along the length thereof. In operation, the carbon basket passes current to the anodic pieces at the multiple points of contact and substantially uniform current flow is maintained.

The Anodic Assembly

Figure 2:
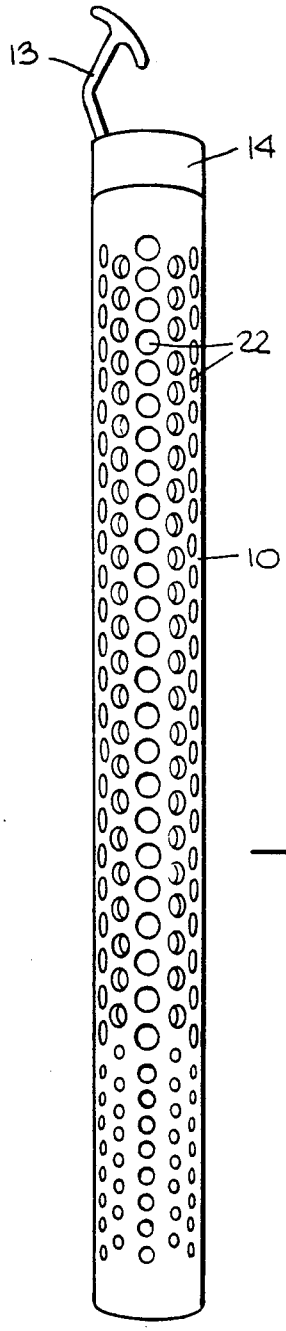
FIG. 2 is a perspective view of the anodic assembly.
Figure 3:
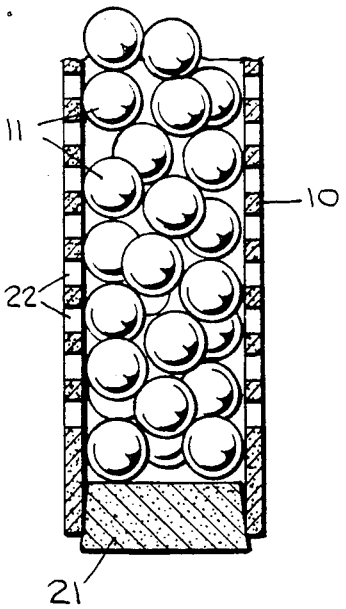
FIG. 3 is a longitudinal section taken through the assembly.

Referring now to FIGS. 2 and 3, it will be seen that the cylindrical basket 10 is provided at its bottom end with a conical sealing plug 21 which is formed of the same material and is force fit or epoxied in place.

The basket is fabricated of a tube of conductive carbon material. Carbon occurs in two forms: amorphous and crystalline; graphite being a crystallized form of carbon. The amorphous forms include coke and lampblack. Coal is an impure form of amorphous carbon.

Most carbons used for electrical purposes are made from a mixture of powdered carbon and graphite plus binders such as pitch and resins which are mixed into a homogeneous mass. This mass is extruded or molded into the desired form and then baked. When the formed body is baked to about 900° C. with the air excluded, the volatile-carrier of the binder is driven off and the remaining material is carbonized.

To create a basket suitable for the assembly, an extruded carbon/graphite tube formed in the above-described manner must be perforated throughout its entire surface, except for the top collar region, to expose the anodic pieces held therein to the electrolyte. For this purpose, rows of holes 22 are drilled along the tube at equi-spaced lines on its circumference, the rows being staggered with respect to each other.

Because of this staggered relation, each pair of successive holes in any one row taken in combination with the two intermediate holes in the rows on opposite sides of the one row lie at the corners of a diamond rather than at the corners of a square, as would be the case had the rows not been staggered. This diamond configuration makes it possible to provide a large number of openings uniformly distributed throughout the structure without unduly weakening the tube.

However, a carbon graphite tube made by conventional molding or extrusion procedures, followed by baking at high temperature, cannot easily be drilled without fracturing or cracking the tube wall. In order to make drilling possible without such adverse effects, the tube is first coated with a plastisol (a dispersion of finely divided resin in a plasticizer).

The plastisol impregnates the surface of the carbon/graphite tube and, when cured, creates a reinforcement skin which is electrically non-conductive. When the plastisol-coated surface of the carbon/graphite tube is then drilled, the skin acts to prevent cracking, and the holes drilled through the tube are smooth and clean.

The fact that the outer skin of the tube is nonconductive does not interfere with anodic activity, for the upper end of the tube about which the conductive collar is clamped is uncoated and conductive, and the anodic pieces within the tube make the multiple contact with the conductive, uncoated inner surface of the tube.

While there has been shown and described a preferred embodiment of ANODIC ASSEMBLY FOR ELECTROPLATING in accordance with the invention, it will be appreciated that many changes and modifications may be made therein without, however, departing from the essential spirit thereof. Thus while the anode assembly is of particular value for tin and other plating operations in a fluoborate electrolyte, the assembly may be used in any plating operation requiring a conductive basket for anodic pieces which is nonreactive with whatever electrolyte is used.

I claim:

1. An anodic assembly immersible in an acidic electrolyte for electroplating an article with a specific metal, said assembly comprising:

A. a cylindrical basket formed of a tube of conductive carbon material formed of an extruded graphite composition, said tube having an open top and a bottom closure of the same material, said tube having its outer surface impregnated with a cured plastisol to form a protective skin thereon which permits drilling of said tube without cracking and being perforated by a cylindrical array of drilled holes all having the same diameter; and B. a replenishable pile of anodic pieces filling said basket, said pieces being formed of said metal and having a maximum dimension smaller than the top opening of the tube and larger than the diameter of the holes.

2. An assembly as set forth in claim 1, wherein said basket is provided with a conductive collar clamped onto the upper end thereof and attached to a conductive hook.

3. An assembly as set forth in claim 1, wherein said array of holes is constituted by rows of holes which extend along the length of the tube, the holes in the rows being in staggered relation.

4. An assembly as set forth in claim 1, wherein said electrolyte is fluoborate and said pieces are formed of tin or a tin alloy.

5. An assembly as set forth in claim 4, wherein said pieces are ball shaped.

6. The method of forming a cylindrical basket for inclusion in an anodic assembly immersible in an acidic electrolyte for electroplating an article with a specific metal, which basket is fillable with pieces of said metal, said method comprising the steps of:

A. forming a tube of conductive graphite having pores therein by mixing carbon and graphite powders with a binder of resin in a volatile carrier to form a mass which is extruded into tubular form, the extruded form being baked to volatilize the resin;

B. coating the outer surface of the tube with plastisol to impregnate the pores thereof and then permitting the plastisol to cure to form a protective skin; and C. drilling holes in the tube through the skin to expose said pieces of metal to said electrolyte.

* * * * *